US007726419B2

(12) United States Patent
Cruz

(10) Patent No.: US 7,726,419 B2
(45) Date of Patent: Jun. 1, 2010

(54) DRILL BIT, SYSTEM, AND METHOD FOR DRILLING A BOREHOLE IN AN EARTH FORMATION

(75) Inventor: Antonio Maria Guimaraes Leite Cruz, Rijswijk (NL)

(73) Assignee: Shell Oil Company, Houston, TX (US)

( * ) Notice: Subject to any disclaimer, the term of this patent is extended or adjusted under 35 U.S.C. 154(b) by 474 days.

(21) Appl. No.: 10/557,404

(22) PCT Filed: May 25, 2004

(86) PCT No.: PCT/EP2004/050913

§ 371 (c)(1), (2), (4) Date: Nov. 18, 2005

(87) PCT Pub. No.: WO2004/104363

PCT Pub. Date: Dec. 2, 2004

(65) Prior Publication Data

US 2006/0249309 A1 Nov. 9, 2006

(30) Foreign Application Priority Data

May 26, 2003 (EP) ..... 03076613

(51) Int. Cl.
*E21B 10/58* (2006.01)

(52) U.S. Cl. ..... 175/430; 175/415

(58) Field of Classification Search ..... 175/415, 175/426, 420.1, 430, 431
See application file for complete search history.

(56) References Cited

U.S. PATENT DOCUMENTS 3,140,748 A 7/1964 Engle et al.
3,258,077 A 6/1966 Phipps ..... 175/339

(Continued)

FOREIGN PATENT DOCUMENTS

DE 4200580 3/1993

(Continued)

OTHER PUBLICATIONS

International Search Report dated Sep. 1, 2004.

(Continued)

*Primary Examiner*—Daniel P Stephenson

(57) ABSTRACT

A drill bit for drilling a borehole in an earth formation. The drill bit has a central longitudinal axis and may be operated by applying at least a rotary motion about the central longitudinal axis and optionally applying longitudinal reciprocal movement to the drill bit so as to exert a percussive force on the borehole bottom. The drill bit has a surface provided with a plurality of shear cutters having a rake surface arranged to induce a scraping movement along the borehole bottom upon application of the rotary motion. The rake surface, during operation, faces the direction of rotation at a back-rake angle of less than 90°, wherein the backrake angle is defined as the angle included between the projection of a line perpendicular to the rake surface on a plane defined by the central longitudinal axis and the direction of the tangential velocity component of the shear cutter and a plane perpendicular to the longitudinal axis. One or more of the shear cutters is provided with a pre-cut flat impact surface essentially parallel to the plane perpendicular to the longitudinal axis.

19 Claims, 4 Drawing Sheets

U.S. PATENT DOCUMENTS

| | | | | | |
|---|---|---|---|---|---|
| 3,269,470 | A | | 8/1966 | Kelly, Jr. | 175/410 |
| 3,388,756 | A | | 6/1968 | Varel et al. | 175/410 |
| 3,709,308 | A | | 1/1973 | Rowley et al. | 175/329 |
| 3,788,409 | A | | 1/1974 | Curington | 175/410 |
| 3,955,635 | A | | 5/1976 | Skidmore | 175/400 |
| 4,051,912 | A | | 10/1977 | White | 175/410 |
| 4,296,825 | A | | 10/1981 | Larsson | 175/410 |
| 4,558,753 | A | | 12/1985 | Barr | 175/329 |
| 4,607,712 | A | | 8/1986 | Larsson | 175/410 |
| 4,676,324 | A | | 6/1987 | Barr et al. | 175/393 |
| 4,716,976 | A | | 1/1988 | Isakov | 175/410 |
| 4,823,892 | A | | 4/1989 | Fuller | 175/329 |
| 4,991,670 | A | | 2/1991 | Fuller et al. | 175/329 |
| 5,004,056 | A | | 4/1991 | Goikhman et al. | 175/293 |
| 5,025,875 | A | | 6/1991 | Witt | 175/393 |
| 5,244,039 | A | | 9/1993 | Newton, Jr. et al. | 175/431 |
| 5,460,233 | A | * | 10/1995 | Meany et al. | 175/428 |
| 5,595,252 | A | | 1/1997 | O'Hanlon | 175/57 |
| 5,601,477 | A | * | 2/1997 | Bunting et al. | 451/59 |
| 5,890,551 | A | | 4/1999 | Liljebrand et al. | 175/418 |
| 5,992,547 | A | | 11/1999 | Caraway et al. | 175/385 |
| 6,202,770 | B1 | * | 3/2001 | Jurewicz et al. | 175/428 |
| 6,253,864 | B1 | | 7/2001 | Hall | 175/415 |
| 6,290,002 | B1 | | 9/2001 | Comeau et al. | 175/73 |
| 6,527,065 | B1 | | 3/2003 | Tibbitts et al. | 175/339 |
| 6,672,406 | B2 | * | 1/2004 | Beuershausen | 175/57 |
| 6,918,455 | B2 | | 7/2005 | Meyers et al. | 175/420.2 |
| 2002/0066601 | A1 | | 6/2002 | Meiners et al. | 175/431 |
| 2005/0269139 | A1 | * | 12/2005 | Shen et al. | 175/430 |
| 2006/0131075 | A1 | | 6/2006 | Cruz | 175/57 |
| 2006/0249309 | A1 | | 11/2006 | Cruz | 175/57 |

FOREIGN PATENT DOCUMENTS

| | | | |
|---|---|---|---|
| EP | 0563561 | | 10/1993 |
| WO | 01/33031 | | 5/2001 |
| WO | 02/099242 | | 12/2002 |
| WO | 03/004249 | | 1/2003 |
| WO | 03/031763 | | 4/2003 |
| WO | WO03031763 | A1 | 4/2003 |
| WO | WO03042492 | A1 | 5/2003 |
| WO | WO2004104362 | A1 | 12/2004 |
| WO | WO2004104363 | | 12/2004 |
| WO | WO2004111381 | A1 | 12/2004 |

OTHER PUBLICATIONS

Int. Preliminary Examination Report (PCT/EP2004/050913).

* cited by examiner

DRILL BIT, SYSTEM, AND METHOD FOR DRILLING A BOREHOLE IN AN EARTH FORMATION

The present application claims priority of European Patent Application No. 03076613.3 filed 26 May 2003.

Field of the Invention

The invention relates to a drill bit for drilling a borehole in an earth formation, the drill bit having a central longitudinal axis and being operable by applying at least a rotary motion about the central longitudinal axis and optionally applying longitudinal reciprocal movement to the drill bit so as to exert a percussive force on the borehole bottom.

The invention further relates to a drilling system for drilling a borehole in an earth formation, comprising a drill string provided with such a drill bit, and to a method of drilling a bore hole into a subterranean earth formation.

The invention also relates to a method of drilling a borehole in an earth formation.

BACKGROUND OF THE INVENTION

A drilling system comprising a percussive shearing drill bit is known and described in U.S. Pat. No. 6,253,864. FIG. 4 of said US patent depicts a percussive shearing bit having a unitary body, a means for attachment to a drill string, and a plurality of blades housing a plurality of shear cutting elements. Fluid outlets are situated on the head of the unitary body between the blades. The blades consist of a series of receptacles to house the shear cutting elements and a shelf that runs along each blade before the cutting elements. The shelf serves to direct cuttings away from the operative surface of the bit.

In operation, the known percussive shearing drill bit is rotated about its longitudinal axis shearing off the rock formation as the drill bit rotates. A hammer simultaneously impacts the bit thereby providing an additional percussive drilling force. The shear cutting elements have been specially designed to withstand the unusual stresses induced by combined percussive/shear drilling, in that a distal portion of the shear cutter has been rounded to prevent large localised stresses in the cutters. Thus in the shear cutting elements a compromise is found for both shearing and axial cutting.

The known drilling system has been found to suffer from the risk of stick-slip torsional vibrating during drilling of certain types of earth formations. When this occurs, the bit is captured to a standstill into the earth formation while the drill string is twisted by the surface rotary drive until it abruptly releases with relatively high rotational speed. Such a stick-slip torsional vibration repeats periodically and the high rotational speed associated with the stick-slip torsional vibration can severly damage the cutters on the drill bit.

SUMMARY OF THE INVENTION

According to a first aspect of the invention there is provided a drill bit for drilling a borehole in an earth formation, the drill bit having a central longitudinal axis and being operable by applying at least a rotary motion about the central longitudinal axis and optionally applying longitudinal reciprocal movement to the drill bit so as to exert a percussive force on the borehole bottom, the drill bit comprising a surface provided with a plurality of shear cutters having a rake surface arranged to induce a scraping movement along the borehole bottom upon application of the rotary motion, the rake surface during operation facing the direction of rotation at a back-rake angle of less than 90° wherein the back-rake angle is defined as the angle included between the projection of a line perpendicular to said rake surface on a plane defined by the central longitudinal axis and the direction of the tangential velocity component of the shear cutter and a plane perpendicular to said longitudinal axis, whereby one or more of the shear cutters is provided, in addition to the rake surface, with a pre-cut flat impact surface oriented essentially parallel to the plane perpendicular to the longitudinal axis.

The drill bit provided with shear cutters having the pre-cut flat impact surface has been found to cause fewer stick-slip torsional vibration modes in the drilling system. Without intending to be limited by this theory, the inventors believe that the stick-slip torsional vibration tendency is reduced by virtue of the fact that the pre-cut flat impact surface is less capable of intruding into the rock material in the bottom of the bore hole than a rake surface ending in a relatively sharp summit edge. This is particularly the case when the drill bit is simultaneously subjected to percussive impacts.

When the drill bit is subjected to optional percussive impacts, the pre-cut flat impact surface of the shear cutters has been found to be relatively wear-resistant compared to shear cutters not having the pre-cut flat impact surface. This may be a result of an impact-stress distributing effect of the flat impact surface.

In a particularly advantageous embodiment of the invention, the drill bit is, in addition to the shear cutters with the pre-cut flat impact surfaces, further provided with a plurality of axial cutters having downwardly facing dome-shaped or essentially hemispherically shaped cutting surface. Herewith particular suitability of the drill bit for percussive operation is achieved.

The axial cutters can be optimised for taking axial impacts without needing to have a shearing capability. Thus, these axial cutters have less tendency to cause stick-slip torsional vibrations than shear cutters and can therefore be added to the drill bit without increasing the risk of causing stick-slip torsional vibrations.

By adding such axial cutters, the optional percussive impacts are distributed over a larger number of cutting elements, thereby sustaining the operational lifetime of the drilling system.

As an additional advantage of provision of such axial cutters, the axial cutters can be optimised for resisting axial impacts, whereas the shearing cutters can independently be optimised for shear cutting without having to take into account axial cutting capability.

In particular, the shear cutters can have a higher shearing effectivity than the axial cutters.

In particular, the axial cutters can be more resistant to axial impacts than the shear cutters.

In accordance with a second aspect of the invention, there is provided a drilling system for drilling a borehole in an earth formation, comprising a drill string provided with a drill bit in accordance with the first aspect of the invention, the drilling system further comprising rotary drive means for rotating the drill bit in the borehole about the bit's central longitudinal axis so as to induce a scraping movement of the shear cutters along the borehole bottom.

Optionally, the drilling system further comprising axial drive means for inducing a longitudinal reciprocal movement of the drill bit in the borehole so as to exert a percussive force to the borehole bottom.

In accordance with a third aspect of the invention, there is provided a method of drilling a bore hole into a subterranean earth formation, comprising the steps of providing a drilling system in accordance with the second aspect, placing the drill bit against the subterranean earth formation that is to be drilled, exercising a rotary motion about the longitudinal axis while maintaining a force on the drill bit against the earth formation in the axial direction, and optionally intermittingly providing percussive strikes on the drill bit.

BRIEF DESCRIPTION OF THE DRAWINGS

The invention will now be illustrated by way of example, with reference to the accompanying drawing wherein.

DETAILED DESCRIPTION OF THE INVENTION

Figure 1A:
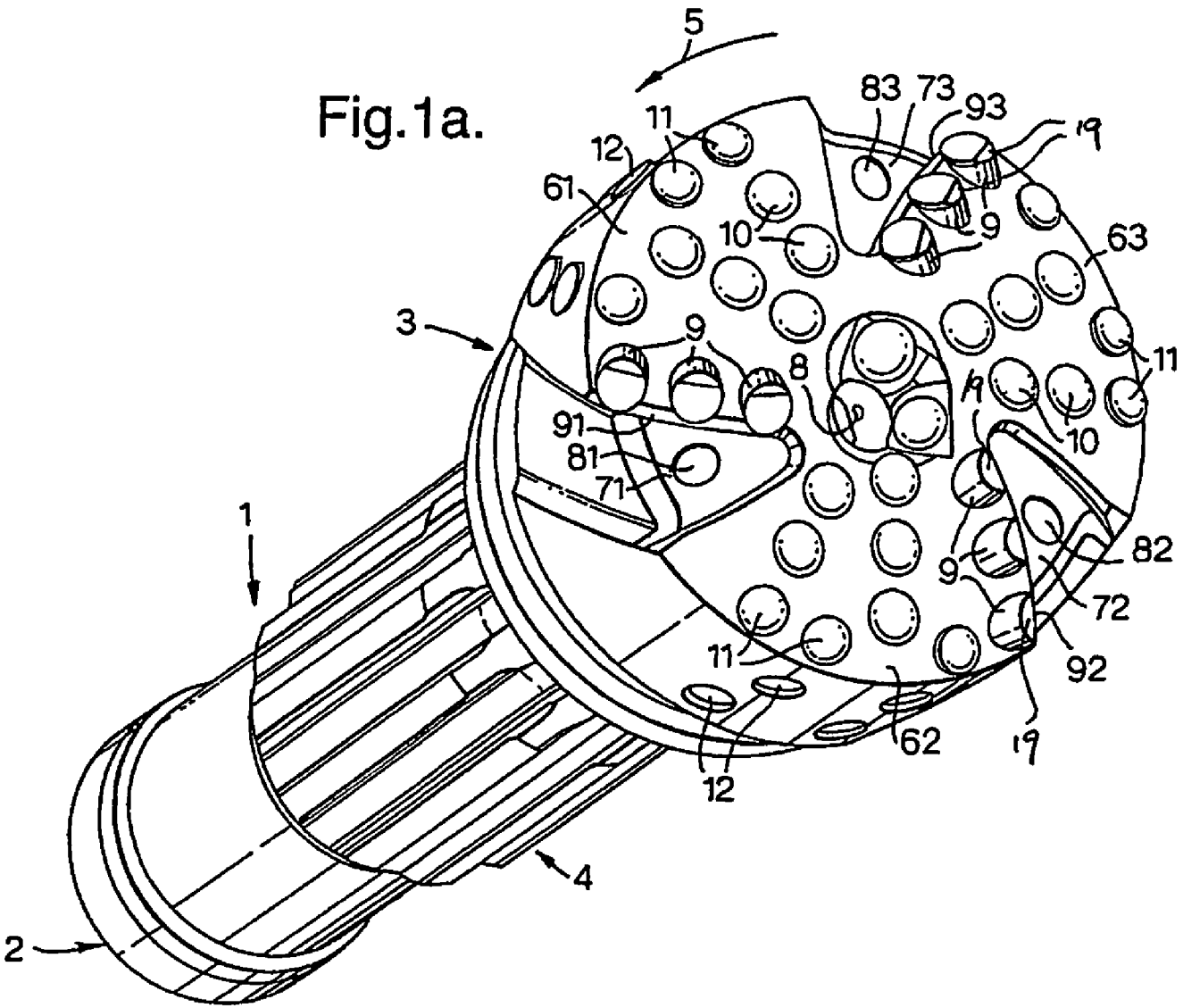
FIG. 1*a* shows a perspective view of a 6" 3-blade percussion drill bit in accordance with an embodiment of the invention.

In the figures, like parts carry identical reference numerals.

A perspective view of a 3-blade percussion drill bit in accordance with an embodiment of the invention is shown in FIG. l*a*. The drill bit comprises a shank 1 stretching longitudinally about a central longitudinal axis of the drill bit, which shank can be especially adapted to fit inside a drill string. The rearward end of the shank is connected to a striking surface 2 to receive impacts from a percussive hammer, preferably a reciprocative piston hammer (not shown). The forward end of the shank is connected to a drilling head 3. The shank 1 is provided with a plurality of splines 4, running essentially longitudinally along the shank 1. The splines 4 serve to rotationally couple the drill string and the shank 1, so that the drill bit is operable by applying both axial percussive motion and rotary motion about the central longitudinal axis.

Figure 1B:
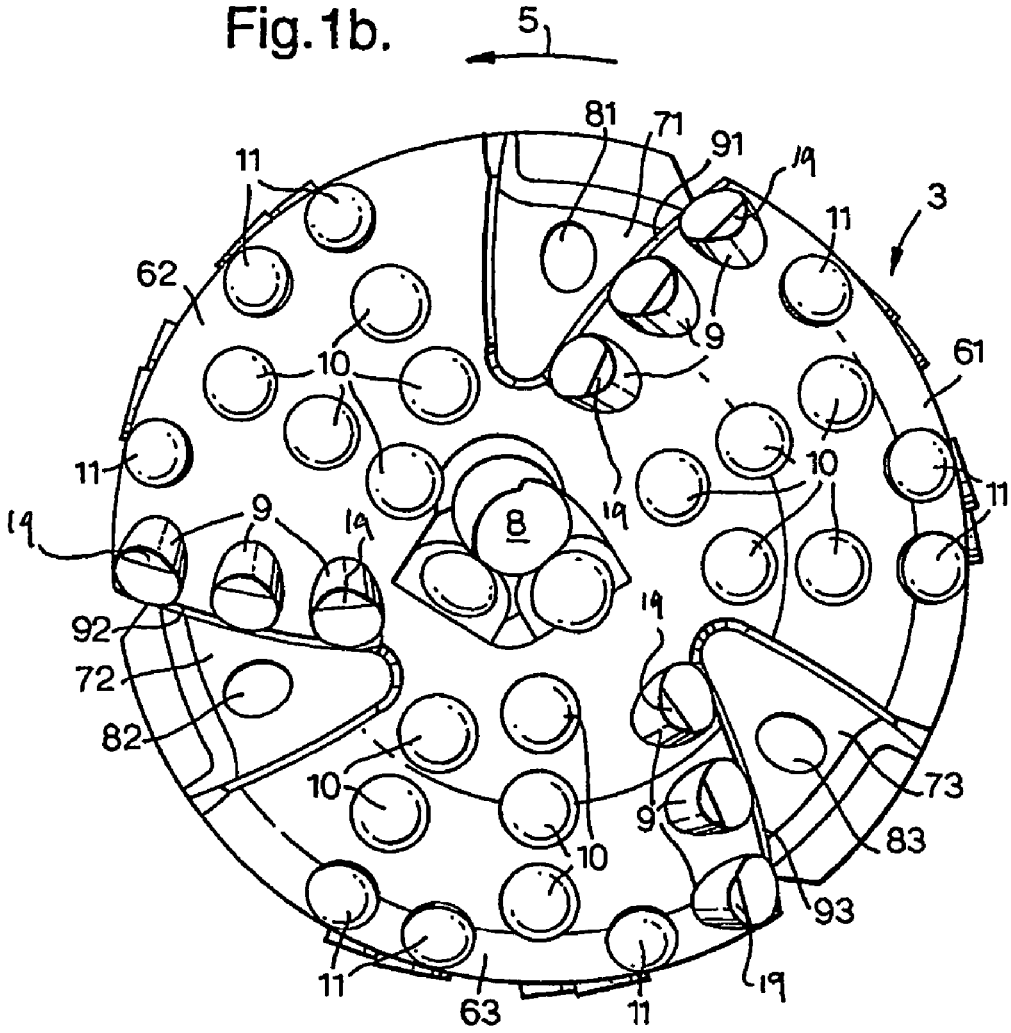
FIG. 1*b* shows a top view of the bit face of the percussion drill bit shown in FIG. l*a*.

Referring now to FIGS. 1*a* and 1*b*, the drilling head 3 is provided with three blades 61, 62, and 63 that protrude from the drill bit. The areas between the blades 61, 62, 63 are recessed with respect to the blades and thus form flow channels 71, 72, 73. The flow channels 71, 72, 73, essentially run radially along the drilling head 3.

A central passage way 8 is provided in the drilling head 3 for passing of flushing fluid. In addition of or instead of the central passage way 8, passage ways 81, 82, 83, can be provided in the flow channels 71, 72, 73 between the blades 61, 62, 63. The passage ways are all connected to a central longitudinal bore (not shown) running through the shank 1.

In hydro-carbon well drilling operations, the drill string is conventionally rotated in clock-wise direction. Arrows 5 in FIGS. 1*a* and 1*b* depict the direction of rotary motion that, in operation, is applied to the drill bit.

The blades 61, 62, 63 thus each have a leading edge 91, 92, 93, with respect to the direction of rotary motion 5. Shear cutters 9 are provided in a row on the leading edge 91, 92, 93 of each respective blade 61, 62, 63. Each row of shear cutters 9 has a flow channel associated with it directly in front of the row of shear cutters 9 with respect to the direction of rotary motion 5. The shear cutters 9 have a shape optimised for scraping along the bottom of the bore hole and thereby shearing pieces of the earth formation from the bottom of the bore hole. In addition to a rake surface, the shear cutters 9 are provided with a pre-cut flat impact surface 19 in their distal portions, such as will be discussed in more detail below with reference to FIG. 2.

Behind each row of shear cutters 9, thus in a trailing position with respect each row of shear cutters 9, axial cutters 10, 11, are provided on the blades 61, 62, 63. The axial cutters 10, 11, have a shape optimised for axially indenting the earth formation in the bottom of the bore hole and thereby possibly crushing the earth formation.

The outer peripheral sections of the blades 61, 62, 63 can be provided with gauge protectors 12, preferably PDC coated.

Figure 2:
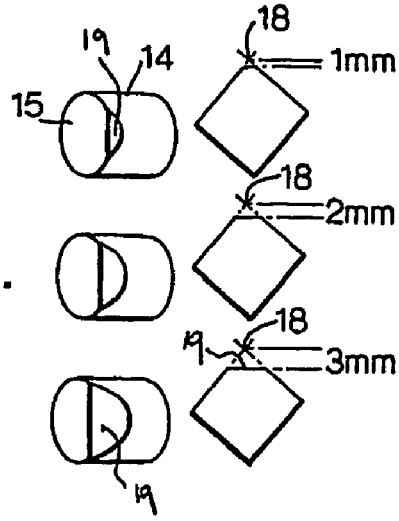
FIG. 2 schematically shows different shear cutters having pre-cut flat impact surface.

The shear cutters 9 are PDC cutters. FIG. 2 schematically shows the provision of the pre-cut flat impact surface 19 on these shear cutters for different pre-cutting depths of 1 mm, 2 mm and 3 mm. The pre-cutting depth corresponds to the normal distance between the pre-cut impact surface and the summit point 18 where the shear cutter shank outer shell and the rake surface come together. The rake surface back-rake angle of each of these shear cutters is 40° as an example, but any angle smaller than 90° can be applied. The impact surface 19 has an impact surface back-rake angle that is greater than the rake surface back-rake angle. The best result is obtained when the impact surface back-rake angle is essentially 90°.

It can be seen that the pre-cut flat impact surface area increases as the pre-cutting depth increases. Preferably, the pre-cutting depth is between 1 and 3 mm.

Figure 3A:
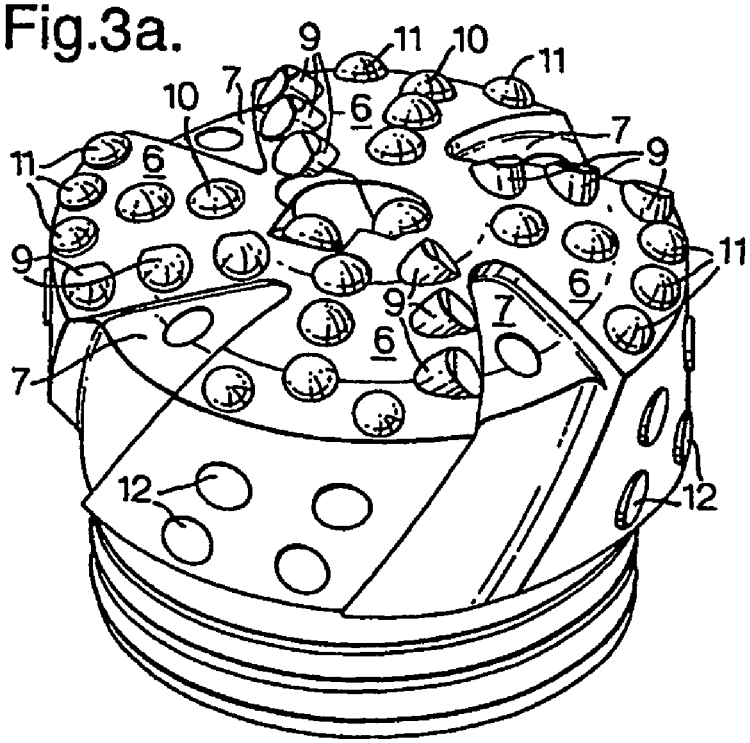
FIG. 3*a* shows a perspective view of a 6" 4-blade percussion drill bit in another embodiment of the invention.
Figure 3B:
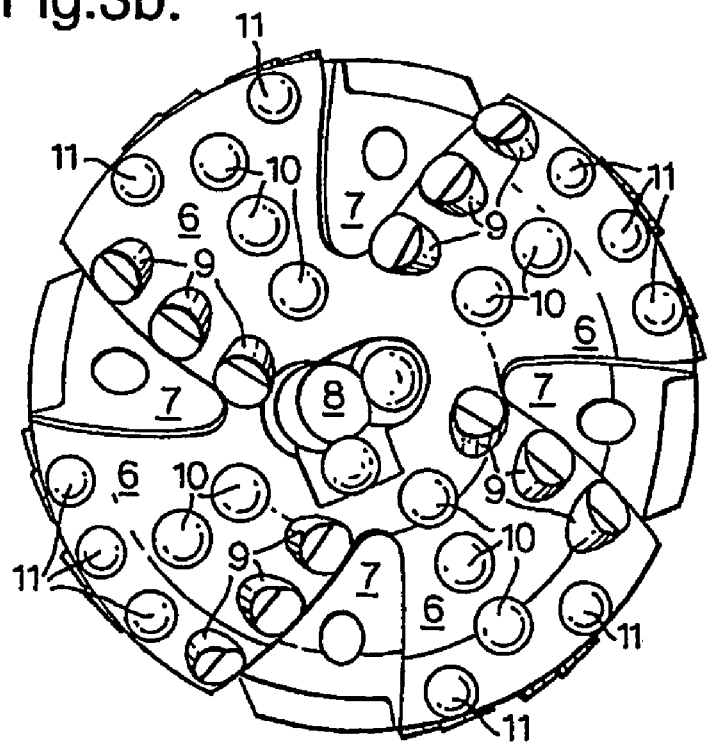
FIG. 3*b* shows a top view of the bit face of the percussion drill bit shown in FIG. 3*a*.

FIG. 3*a* shows a perspective view, and FIG. 3*b* a top view, of a variant of the drill bit of the invention having four blades 6 and consequently four flow channels 7. In other respects, this variant is similar to the one shown in FIGS. 1*a* and 1*b*. In particular, the pre-cut flat impact surfaces, and preferably also positioning of the rows of shear cutters 9 on the leading edges of the blades and the positioning of the axial cutters 10, 11 in a trailing position with respect to the rows of shear cutters 9, are similar to the first discussed embodiment.

Figure 4:
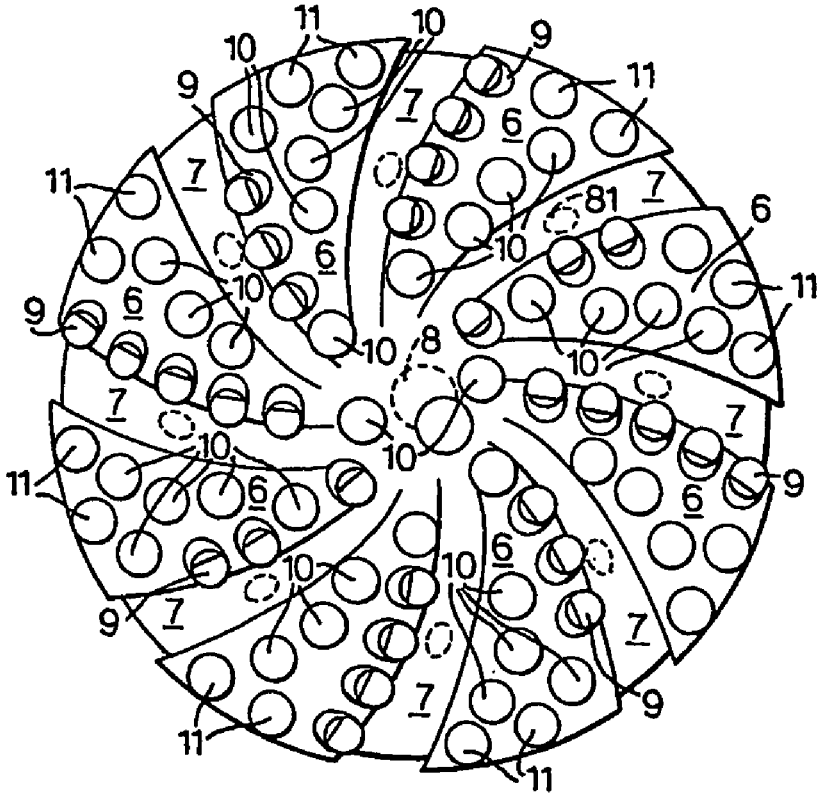
FIG. 4 shows a top view of an 8" bit face according to still another embodiment of the invention, having 8 blades.

The diameter of the outer periphery of the percussion drill bits discussed above in FIGS. 1*a* and 1*b*, and FIGS. 3*a* and 3*b*, is 6", corresponding to approximately 15 cm. An example of an 8" (corresponding to approximately 20 cm outer diameter) bit face is depicted in FIG. 4. This embodiment is based on eight blades 6 and a corresponding number of flow channels 7. Each flow channel 7 is provided with a passage way 81 for allowing entry of flushing fluid into the respective flow channel. Since this bit face of FIG. 4 has a larger diameter than the ones shown in FIGS. 1 and 3, a larger number of shear cutters 9 and axial cutters 10,11 can be accommodated.

In the above described percussion drill bits depicted in FIGS. 3*a* and 3*b* and FIG. 4, the shear cutters in a first said row of shear cutters are positioned at mutually different radial positions than the shear cutters in a second said row of shear cutters on another blade. This way, the gaps left between adjacent shear cutters in one row are covered by the shear cutters in a next row on a different blade when the drill bit is rotated. Ideally, the circular paths of the collection of shear cutters slightly overlap such that a continuous band of shear cutting is achieved over a majority of the area in the bore hole bottom surface.

Figure 5:
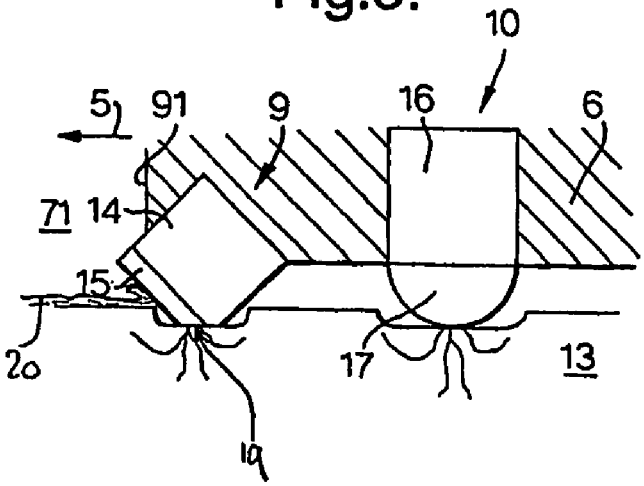
FIG. 5 shows a schematic cross section of the cutter arrangement.

FIG. 5 depicts a schematic representation of the cutter arrangement, as seen in a tangential cross section. Visible are a blade 6 and its leading edge 91. A shear cutter 9 is provided on or adjacent to the leading edge 91, to shear-cut the earth formation 13 and scrape off cutting debris 20 into the flow channel 71. Behind the shear cutter 9 in relation to the direction of rotary movement 5, is an axial cutter 10.

The shear cutter 9 has a _/-shaped cross section, whereby the leading slanted side corresponds to the rake surface. The bottom side 19 forms the pre-cut flat impact surface that stretches essentially perpendicular to the central longitudinal axis of the drill bit and in normal operation essentially parallel to the bottom of the bore hole. The trailing slanted side corresponds to a shear cutter shank 14 made of a hard material, for which tungsten carbide is suitable.

The rake surface facing the associated flow channel 71, is covered with a layer 15 of polycrystalline diamond. Such a shear cutter having a polycrystalline diamond cutting surface is known as a polycrystalline diamond compact cutter, or PDC cutter. Depending on the rake surface back rake angle, the thickness of layer 15 and the pre-cutting depth, the pre-cut flat impact surface 19 only exposes the layer 15 of polycrystalline diamond or in addition it also exposes the shear cutter shank which is the case in FIG. 5.

The axial cutter 10 is formed of an axial cutter shank 16 which at least on one side is provided with a hemispherical or dome shaped cutting surface 17. The cutter is made of a hard material, for which tungsten carbide is a suitable material. Optionally, the cutter can be provided with a layer of polycrystalline diamond thus forming a PDC axial cutter.

In order to protect the shear cutter 9 from full exposure to the percussive impacts, they may be arranged recessed with respect to the axial cutters 10,11 such that the axial cutters 10,11 impact on the rock 13 in the bottom of the bore hole before the shear cutter 9 does. Ideally, the recessed arrangement causes the shear cutter 9 to be elevated above the rock 13 in the bottom of the bore hole, at a height corresponding to the amount of recess, when the axial cutters 10,11 just start to penetrate a fresh piece of rock 13. When the impact follows through, the final penetration depth of the shear cutter 9 is less than that of the axial cutters 10,11 by an amount corresponding to the amount of recess. Any amount of recess has a beneficial effect on the operational lifetime of the shear cutters, but a recessed arrangement by at least 0.25 mm is recommended, while at least 0.50 mm is preferred.

In the examples shown in FIGS. 1*a* and 1*b*, FIGS. 3*a* and 3*b*, and FIG. 4, the outermost axial cutters 11 are PDC axial cutters and the other axial cutters 10 are tungsten carbide axial cutters. Thus, in these bit faces the outer most axial cutters 11 are harder and/or more wear resistant than the remaining axial cutters 10.

In operation, the percussion drill bit is incorporated in a drilling system whereby the percussion drill bit is held by a drill string. The drilling system further comprises:

rotary drive means for rotating the drill bit in the borehole so as to induce a scraping movement of the shear cutters along the borehole bottom; and optionally axial drive means for inducing a longitudinal reciprocal movement of the drill bit in the borehole so as to induce at least the axial cutters to exert a percussive force to the borehole bottom, which first and second drive means are both operated simultaneously. The axial drive means are preferably formed by a hammer, more preferably a reciprocative piston hammer. During a drilling operation, a drilling fluid is pumped through the drill string which is in fluid connection with the passages 8, 81, 82, 83. Suitable drilling fluids are mud, water, oil or foam, and can vary in dependence of the type of formation to be drilled.

As can best be seen in FIG. 5, the axial cutters 10,11 and the shear cutters 9 both are in contact with the earth formation 13, so that the percussive impact force is distributed over as many cutters as possible. Herewith the operational lifetime of the cutters is sustained as much as possible. In order to reduce the impact stress concentration acting on the shear cutters, the shear cutters are provided with a pre-cut impact surface as described above. These pre-cut impact surfaces, which can be viewed upon as pre-cut wear surfaces, are also beneficial in reducing the tendency to excite so-called slip-stick torsional vibrations in the drilling system.

As a result of the axial percussive impacts, the formation 13 underneath the cutters crushes. As the bit rotates, the shear cutters 9 scrape along the bottom hole surface and build up rock flour and chips from the cutting debris and drilling fluid. The rock flour and chips are pushed in front of the shear cutters 9 where there is a flow channel 7 with flushing fluid running through it in an essentially radially outward direction. Herefrom the scraped cutting debris is flushed to the bore hole annulus and removed from the bottom hole area.

In order to further assist the flushing of cutting debris though the flow channels, the rake surface of each shear cutter can have a secondary inclination relative to the radial direction of the drill bit, the secondary inclination being such that the rake surface pushes drill cuttings from the rock formation in radially outward or radially inward direction.

Typical suitable operating conditions for the drill bits described above, include a weight on bit lying in a range between 3 to 6 metric tons. The amount of percussive energy exercised on the drill bit per percussive blow can lie in a range of between 0.3 kJ to 5 kJ. Typically, the drilling system can be operated using between 10 and 50 kW of percussive power, at a percussion frequency between 9 and 30 Hz.

The drill bits shown and described above are provided with both shear cutters and axial cutters. However, since neither their function nor the function of the pre-cut flat impact surface, depend on the presence of the axial cutters, the shear cutters having a pre-cut flat impact surface can also be applied in drill bits without the presence of separate axial cutters and being operable by rotary motion either with or without any percussive motion.

Moreover, the drill bits of the above described examples have 6" and 6" outer diameters by way of example. It will be understood that other diameters can be applied in a similar fashion. Likewise, the invention is not limited by the number of blades shown. Any number of blades can be provided.

I claim:

1. A drill bit for drilling a borehole in an earth formation, the drill bit having a central longitudinal axis and being operable by applying at least a rotary motion about the central longitudinal axis and optionally applying longitudinal reciprocal movement to the drill bit so as to exert a percussive force on the borehole bottom:

the drill hit comprising a surface provided with a plurality of shear cutters having a rake surface arranged to induce a scraping movement alone the borehole bottom upon application of the rotary motion, the rake surface during operation facing the direction of rotation at a rake surface back-rake angle of less than 90°, wherein the rake surface back-rake angle is defined as the angle included between the projection of a line perpendicular to said rake surface on a plane defined by the central longitudinal axis and the direction of the tangential velocity component of the shear cutter and a plane perpendicular to said longitudinal axis;

wherein one or more of the shear cutters is provided, in addition to the rake surface, with a pre-cut flat impact surface oriented essentially parallel to the plane perpendicular to the longitudinal axis: and wherein the rake surface of each shear cutter has a secondary inclination relative to the radial direction of the drill bit, the secondary inclination being such that in operation the rake surface pushes drill cuttings from the rock formation in radially outward or radially inward direction.

2. The drill bit of claim 1 wherein the shear cutters are arranged in a plurality of substantially radially aligned rows.

3. The drill bit of claim 2, wherein the shear cutters in a first said row and the shear cutters in a second said row adjacent to the first row, comprise rake surfaces at mutually different radial positions.

4. The drill bit of claim 1, wherein each cutter is a Poly-crystalline Diamond Compact cutter including a shank made of a base material and a top layer made of a poly-crystalline diamond material.

5. The drill bit of claim 1, wherein said one or more shear cutters each have a longitudinal section that has an inverted trapezoid shape.

6. The drill bit of claim 1, wherein said surface further comprises a plurality of axial cutters each having a downwardly facing dome-shaped or essentially hemispherically shaped cutting surface.

7. The drill bit of claim 1, wherein the impact surface has an impact surface back-rake angle that is greater than the rake surface back-rake angle, the impact surface back-rake angle being defined analogous to the rake surface back-rake angle.

8. A drilling system for drilling a borehole in an earth formation, comprising;

a drill string provided with a drill bit having a central longitudinal axis and being operable by applying at least a rotary motion about the central longitudinal axis and optionally applying longitudinal reciprocal movement to the drill bit so as to exert a percussive force on the borehole bottom, the drill bit comprising a surface provided with a plurality of shear cutters having a rake surface arranged to induce a scraping movement along the borehole bottom upon application of the rotary motion, the rake surface during operation facing the direction of rotation at a rake surface back-rake angle of less than 90°, wherein the rake surface back-rake angle is defined as the angle included between the projection of a line perpendicular to said rake surface on a plane defined by the central longitudinal axis and the direction of the tangential velocity component of the shear cutter and a plane perpendicular to said longitudinal axis, and wherein one or more of the shear cutters is provided, in addition to the rake surface, with a pre-cut flat impact surface oriented essentially parallel to the plane perpendicular to the longitudinal axis; and wherein the rake surface of each shear cutter has a secondary inclination relative to the radial direction of the drill bit, the secondary inclination being such that in operation the rake surface pushes drill cuttings from the rock formation in radially outward or radially inward direction;

the drilling system further comprising rotary drive means for rotating the drill bit in the borehole about the bit's central longitudinal axis so as to induce a scraping movement of the shear cutters along the borehole bottom.

9. The drilling system of claim 8, further comprising axial drive means for inducing a longitudinal reciprocal movement of the drill bit in the borehole so as to exert a percussive force to the borehole bottom.

10. The drilling system of claim 8, wherein the impact surface has an impact surface back-rake angle that is greater than the rake surface back-rake angle, the impact surface back-rake angle being defined analogous to the rake surface back-rake angle.

11. The drilling system of claim 10, wherein the impact surface back-rake angle is essentially about 90°.

12. The drilling system of claim 8, wherein said one or more shear cutters each have an inverted trapezoidal shaped longitudinal section.

13. The drilling system of claim 8, wherein said surface further comprises a plurality of axial cutters each having a downwardly facing dome-shaped or essentially hemispherically shaped cutting surface.

14. A method of drilling a bore hole into an earth formation, comprising the steps of providing a drilling system comprising a drill string provided with a drill bit having a central longitudinal axis and being operable by applying at least a rotary motion about the central longitudinal axis and optionally applying longitudinal reciprocal movement to the drill bit so as to exert a percussive force on the borehole bottom, the drill bit comprising a surface provided with a plurality of shear cutters having a rake surface arranged to induce a scraping movement along the borehole bottom upon application of the rotary motion, the rake surface during operation facing the direction of rotation at a rake surface back-rake angle of less than 90°, wherein the rake surface back-rake angle is defined as the angle included between the projection of a line perpendicular to said rake surface on a plane defined by the central longitudinal axis and the direction of the tangential velocity component of the shear cutter and a plane perpendicular to said longitudinal axis, and wherein one or more of the shear cutters is provided, in addition to the rake surface, with a pre-cut flat impact surface oriented essentially parallel to the plane perpendicular to the longitudinal axis; and wherein the rake surface of each shear cutter has a secondary inclination relative to the radial direction of the drill bit, the secondary inclination being such that in operation the rake surface pushes drill cuttings from the rock formation in radially outward or radially inward direction placing the drill bit against the subterranean earth formation that is to be drilled;

exercising a rotary motion about the longitudinal axis while maintaining a force on the drill bit against the earth formation in the axial direction; and optionally intermittingly providing percussive strikes on the drill bit.

15. The method of claim 14, wherein the impact surface has an impact surface back-rake angle that is greater than the rake surface back-rake angle, the impact surface back-rake angle being defined analogous to the rake surface back-rake angle.

16. The method of claim 15, whereby the impact surface back-rake angle is essentially about 90°.

17. The method of claim 14, wherein the shear cutters are arranged in a plurality of substantially radially aligned rows.

18. The method of claim 14, wherein said one or more shear cutters each have an inverted trapezoidal shaped longitudinal section.

19. The method of claim 14, wherein wherein said surface further comprises a plurality of axial cutters each having a downwardly facing dome-shaped or essentially hemispherically shaped cutting surface.

* * * * *